US010380945B2

(12) United States Patent
Hwang et al.

(10) Patent No.: US 10,380,945 B2
(45) Date of Patent: Aug. 13, 2019

(54) CURRENT MIRRORING CIRCUIT, PANEL DRIVING APPARATUS AND OLED DRIVER

(71) Applicant: SILICON WORKS CO., LTD., Daejeon (KR)

(72) Inventors: Dong Hyun Hwang, Seoul (KR); Se Won Lee, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 15/826,377

(22) Filed: Nov. 29, 2017

(65) Prior Publication Data

US 2018/0158413 A1 Jun. 7, 2018

(30) Foreign Application Priority Data

Dec. 2, 2016 (KR) ..... 10-2016-0163448

(51) Int. Cl.

| | |
|---|---|
| ***G09G 3/32*** | (2016.01) |
| ***G09G 3/3241*** | (2016.01) |
| ***G05F 3/16*** | (2006.01) |
| ***G09G 3/00*** | (2006.01) |
| ***G09G 3/3233*** | (2016.01) |

(52) U.S. Cl.

CPC ..... *G09G 3/3241* (2013.01); *G05F 3/16* (2013.01); *G09G 3/006* (2013.01); *G09G 3/3233* (2013.01); *G09G 2300/0842* (2013.01); *G09G 2320/0233* (2013.01); *G09G 2320/0295* (2013.01); *G09G 2320/0693* (2013.01)

(58) Field of Classification Search

USPC ..... 330/288

See application file for complete search history.

(56) References Cited

U.S. PATENT DOCUMENTS 6,157,259 A * 12/2000 Dasgupta ..... H03F 3/345 330/288

6,586,888 B2 7/2003 Kitahara et al.

8,174,518 B2 5/2012 Kwon

* cited by examiner

*Primary Examiner* — Joseph R Haley

(74) *Attorney, Agent, or Firm* — Fenwick & West LLP

(57) ABSTRACT

The present invention provides a technology of simultaneously sensing characteristics of a plurality of OLED pixels. Further, a current mirroring circuit for sensing characteristics of OLED pixels can be applied to fields other than sensing characteristics of OLED pixels, and the current mirroring technology can output sensing currents having a uniform magnitude within a predetermined error range to a plurality of output terminals.

14 Claims, 6 Drawing Sheets

CURRENT MIRRORING CIRCUIT, PANEL DRIVING APPARATUS AND OLED DRIVER

CROSS REFERENCE TO RELATED APPLICATION

This application claims priority from Republic of Korea Patent Application No. 10-2016-0163448, filed on Dec. 2, 2016, which is hereby incorporated by reference for all purposes as if fully set forth herein.

BACKGROUND OF THE INVENTION

1. Field of the Invention

The present invention relates to a circuit that mirrors and supplies a current to a plurality of output terminals.

2. Description of the Prior Art

A plurality of OLED pixels are arranged on an OLED (Organic Light Emitting Diode) panel. The OLED pixels may have different characteristics due to differences in the manufacturing environment or differences in the positions where the OLED pixels are disposed.

When the OLED pixels are activated regardless of the differences in characteristic of the OLED pixels, the OLED pixels show undesired brightness and the image quality is deteriorated.

In order to solve this problem, a technology that senses characteristics of OLED pixels and compensates for image data on the basis of the sensed characteristics of the OLED pixels has been developed. However, this technology of the related art individually senses the characteristics of OLED pixels, so it consumes long time to sense all of OLED pixels disposed on an OLED panel.

In particular, the time for a manufacturing process is highly associated with the manufacturing cost, so individually sensing thousands of OLED pixels in order to improve the quality in the manufacturing process increases the manufacturing cost.

SUMMARY OF THE INVENTION

For this reason, an aspect of the present invention is, in one aspect, to provide a technology that simultaneously senses a plurality of OLED pixels.

Meanwhile, a current mirroring circuit for sensing characteristics of OLED pixels can be applied to fields other than sensing characteristics of OLED pixels, and in this respect, another aspect of the present invention is to provide a current mirroring technology that outputs a test current having a uniform magnitude within a predetermined error range to a plurality of output terminals.

In accordance with the above aspects, the present invention provides a current mirroring circuit that includes: a current generation unit configured to generate a first current and a second current; and a plurality of current mirroring units each including an N-type output transistor configured to mirror the first current and a P-type output transistor configured to mirror the second current, and supplying a current corresponding to a difference between the mirroring current of the P-type output transistor and the mirroring current of the N-type output transistor to output terminals, in which source sides of the N-type output transistors of the current mirroring units are connected to different positions on a first wire and source sides of the P-type output transistors of the current mirroring units are connected to different positions on a second wire.

Another aspect of the present invention provides a panel driving apparatus for driving a panel including a plurality of pixels, a plurality of data lines for driving the pixels, and a plurality of sensing lines for sensing characteristics of the pixels, the panel driving apparatus including: a sensing circuit including a plurality of current mirroring units configured to supply test currents to the sensing lines through a plurality of output terminals, to sense signals generated in the pixels by the test currents, to produce pixel sensing data by digitalizing the signals, to include an N-type output transistor configured to mirror a first current and a P-type output transistor configured to mirror a second current, and to supply the test currents corresponding to a difference between the mirroring current of the P-type output transistor and the mirroring current of the N-type output transistor to the output terminals; and a data driving circuit configured to receive image data compensated on the basis of the pixel sensing data, to convert the image data into a data voltage, and to supply the data voltage to the data lines.

Another aspect of the present invention provides an OLED (Organic Light Emitting Diode) driver for driving an OLED panel including a plurality of OLED pixels, a plurality of data lines for driving the OLED pixels, and a plurality of sensing lines for sensing characteristics of the OLED pixels, the OLED driver including: a sensing circuit configured to include a plurality of current mirroring units, which each includes an N-type output transistor configured to mirror a first current and a P-type output transistor configured to mirror a second current and supplies test currents corresponding to a difference between the mirroring current of the P-type output transistor and the mirroring current of the N-type output transistor to the sensing lines through output terminals, and to produce pixel sensing data by digitalizing signals generated in the sensing lines; a data driving circuit configured to receive image data compensated on the basis of the pixel sensing data, to convert the image data into a data voltage, and to supply the data voltage to the data lines.

As described above, according to the embodiment, it is possible to simultaneously sense the characteristics of a plurality of OLED pixels. Accordingly, it is possible to reduce the manufacturing time and manufacturing costs. Further, according to the embodiment, the current mirroring circuit can output test currents having uniform magnitudes within a predetermined error range to a plurality of output terminals. Accordingly, it is possible to reduce a sensing error and the trouble of correcting again a sensing value.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION OF THE EXEMPLARY EMBODIMENTS

Figure 1:
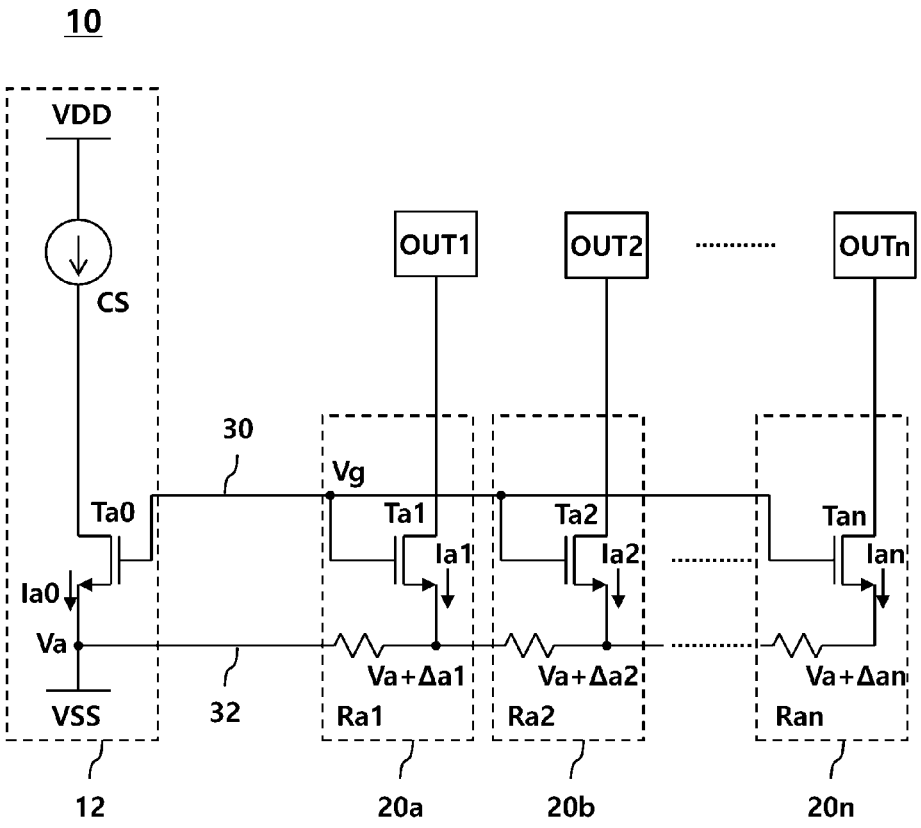
FIG. 1 is a diagram showing an exemplary configuration of a common current mirroring circuit.

Hereinafter, embodiments will be described in detail with reference to the accompanying drawings. In adding reference numerals to elements in each drawing, the same elements will be designated by the same reference numerals, if possible, although they are shown in different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. These terms are merely used to distinguish one structural element from other structural elements, and a property, an order, a sequence and the like of a corresponding structural element are not limited by the term. It should be noted that if it is described in the specification that one component is "connected," "coupled" or "joined" to another component, a third component may be "connected," "coupled," and "joined" between the first and second components, although the first component may FIG. 1 is a diagram showing an exemplary configuration of a common current mirroring circuit.

Referring to FIG. 1, a common current mirroring circuit 10 may include a current generation unit 12 and a plurality of current mirroring units 20*a*, 20*b*, 20*n*.

The current generation unit 12 includes a current source CS and can generate a base current Ia0 through the current source CS.

The current mirroring units 20*a*, 20*b*, 20*n* mirror the base current Ia0 and output mirroring currents Ia1, Ia2, . . . , Ian to a plurality of output terminals OUT1, OUT2, . . . , OUTn.

The current generation unit 12 includes an input transistor Ta0 and the current mirroring units 20*a*, 20*b*, . . . , 20*n* include output transistors Ta1, Ta2, . . . , Tan, respectively.

The input transistor Ta0 and the output transistors Ta1, Ta2, . . . , Tan are connected to each other at gate terminals through a gate wire 30 and at source terminals through a source wire 32.

In this connection, if there is no line resistance in the source wire 32, the gate voltages Vg and the source voltages Va of the transistors Ta0, Ta1, Ta2, . . . , Tan are the same, so mirroring currents Ia1, Ia2, . . . , Ian having substantially the same magnitude as the base current Ia0 flowing to the input transistor Ta0 flow to the output transistors Ta1, Ta2, . . . , Tan. Further, mirroring currents Ia1, Ia2, . . . , Ian having substantially the same magnitude flow to the output terminals OUT1, OUT2, . . . , OUTn connected to the drain terminals of the output transistors Ta1, Ta2, . . . , Tan.

However, there are line resistances Ra1, Ra2, . . . , Ran in the source wire 32 in the actual circuit, so the source voltages Va+Δa1, Va+Δa2, . . . , Va+Δan of the output transistors Ta1, Ta2, . . . , Tan are different. On the other hand, there is a capacitive load in the gate wire 30, so the output transistors Ta1, Ta2, . . . , Tan may have the same gate voltage Vg actually regardless of the line resistances. Accordingly, the gate-source voltages of the transistors Ta0, Ta1, Ta2, . . . , Tan are different and the currents Ia0, Ia1, Ia2, . . . , Ian flowing to the transistors Ta0, Ta1, Ta2, . . . , Tan are also different.

Using this common current mirroring circuit changes the magnitudes of the mirroring currents Ia1, Ia2, . . . , Ian flowing to the output terminals OUT1, OUT2, . . . , OUTn, respectively, so accurate sensing may not be performed. Alternatively, it may be required to post-process sensing values in order to compensate for the deviations of the output terminals OUT1, OUT2, . . . , OUTn.

Figure 2:
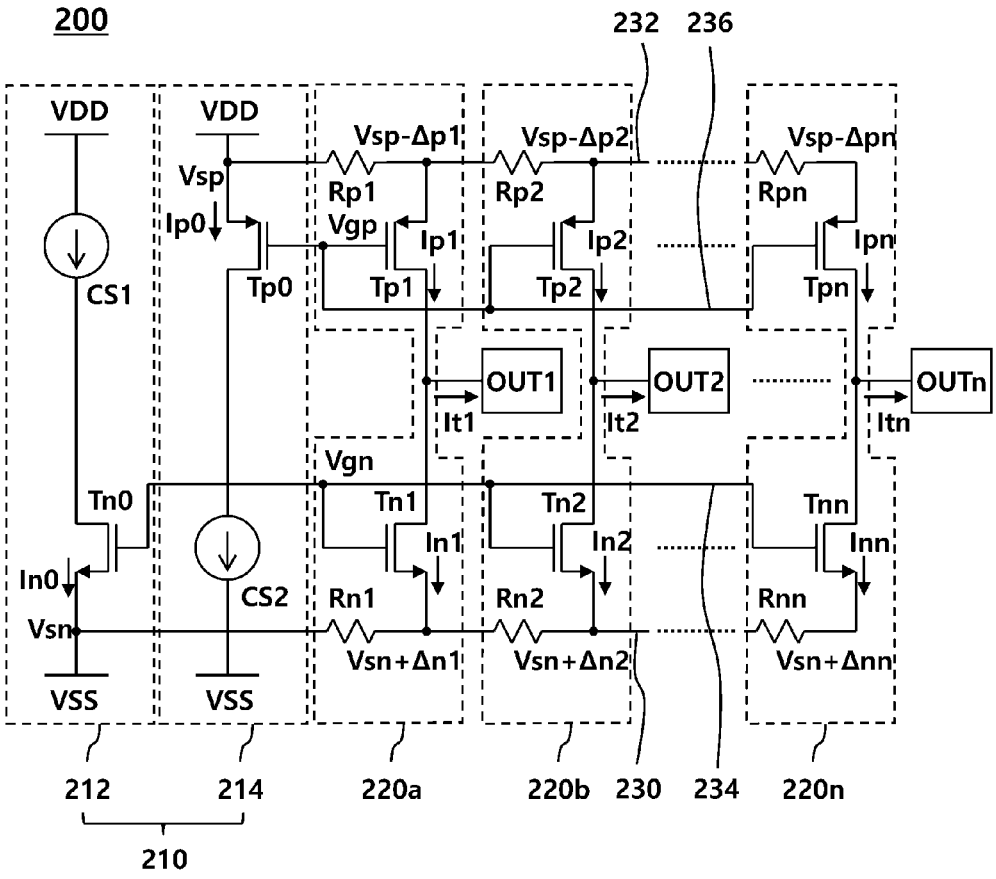
FIG. 2 is a diagram showing the configuration of a current mirroring circuit according to an embodiment.

FIG. 2 is a diagram showing the configuration of a current mirroring circuit according to an embodiment.

Referring to FIG. 2, a current mirroring circuit 200 may include a current generation unit 210 and a plurality of current mirroring units 220*a*, 220*b*, . . . , 220*n*.

The current generation unit 210 can generate a first current In0 and a second current Ip0. The current generation unit 210 may include a first current generation unit 212 that generates the first current In0 and a second current generation unit 214 that generates the second current Ip0.

The first current generation unit 212 may include a first current source CS1 and an N-type input transistor Tn0.

The N-type input transistor Tn0 may be connected to the first current source CS1 at a side, for example, a drain side (hereafter, referred to as a 'drain side') and to a low driving voltage VSS at the other side, for example, a source side (hereafter, referred to as a 'source side'). Further, the first current source CS1 may be connected to a high driving voltage VDD at a side and to the drain side of the N-type input transistor Tn0 at the other side.

The second current generation unit 214 may include a second current source CS2 and a P-type input transistor Tp0.

The P-type input transistor Tn0 may be connected to a high driving voltage VDD at a side, for example, a source side (hereafter, referral to as a 'source side') and to a the second current source CS2 at the other side, for example, a drain side (hereafter, referred to as a 'drain side'). Further, the second current source CS2 may be connected to the drain side of the P-type input transistor Tp0 at a side and to a low driving voltage VSS at the other side.

The current mirroring units 220*a*, 220*b*, . . . , 220*n* may respectively include N-type output transistors Tn1, Tn2, . . . , Tnn that mirror the first current In0 and P-type output transistors Tp1, Tp2, . . . , Tpn that mirror the second current Ip0. The N-type input transistor Tn0 and the N-type output transistors Tn1, Tn2, . . . , Tnn may be NMOSs (N-channel Metal Oxide Semiconductor) Further, the P-type input transistor Tp0 and the P-type output transistors Tp1, Tp2, . . . , Tpn may be PMOSs (P-channel Metal Oxide Semiconductor).

In the current mirroring units 220*a*, 220*b*, . . . , 220*n*, the N-type output transistors Tn1, Tn2, . . . , Tnn may be connected to a first wire 230 at the source sides and to the output terminals OUT1, OUT2, . . . , OUTn at the drain sides. Further, in the current mirroring units 220*a*, 220*b*, . . . , 220*n*, the P-type output transistors Tp1, Tp2, . . . , Tpn may be connected to a second wire 232 at the source sides and to the output terminals OUT1, OUT2, . . . , OUTn at the drain sides.

Further, the current mirroring units 220*a*, 220*b*, . . . , 220*n* can supply test currents It1, It2, . . . , Itn, which correspond to the differences between mirroring currents Ip1, Ip2, . . . , Ipn (hereafter, referred to as 'P-type mirroring currents) of the P-type output transistors Tp1, Tp2, . . . , Tpn and mirroring currents In1, In2, . . . , Inn (hereafter, referred to as 'N-type mirroring currents') of the N-type output transistors Tn1, Tn2, . . . , Tnn, to the output terminals OUT1, OUT2, . . . , OUTn.

According to the connection relationship with the current generation unit 210, the source sides of the N-type output transistors Tn1, Tn2, . . . , Tnn disposed in the current mirroring units 220*a*, 220*b*, . . . , 220*n* may be sequentially connected to different positions on the first wire 230 connected to the source side of the N-type input transistor Tn0. Further, the source sides of the P-type output transistors Tp1, Tp2, . . . , Tpn disposed in the current mirroring units 220*a*, 220*b*, . . . , 220*n* may be sequentially connected to different positions on the second wire 232 connected to the source side of the P-type input transistor Tp0.

A gate side of the N-type input transistor Tn0 and gate sides of the N-type output transistors Tn1, Tn2, . . . , Tnn may be connected to each other through a third wire 234 and the third wire 234 operates as a capacitive load, so gate voltages Vgn of the N-type input transistor Tn0 and the N-type output transistors Tn1, Tn2, . . . , Tnn may be substantially the same.

A gate side of the P-type input transistor Tp0 and gate sides of the P-type output transistors Tp1, Tp2, . . . , Tpn may be connected to each other through a fourth wire 236 and the fourth wire 234 operates as a capacitive load, so gate voltages Vgp of the P-type input transistor Tp0 and the P-type output transistors Tp1, Tp2, . . . , Tpn may be substantially the same.

On the other hand, the first wire 230 is a wire connecting the source side of the N-type input transistor Tn0 disposed in the first current generation unit 212 and the source sides of the N-type output transistors Tn1, Tn2, . . . , Tnn disposed in the current mirroring units 220*a*, 220*b*, . . . , 220*n* to each other, and the current mirroring units 220*a*, 220*b*, . . . , 220*n* each have a predetermined element area, so the source sides of the N-type output transistors Tn1, Tn2, . . . , Tnn may be connected to different positions on the first wire 230. Further, there are line resistances Rn1, Rn2, . . . , Rnn in the first wire 230 and the N-type mirroring current In1, In2, . . . , Inn flow through the first wire 230, so the source side voltages Vsn+Δn1, Vsn+Δn2, . . . , Vsn+Δnn of the N-type output transistors Tn1, Tn2, . . . , Tnn may be different.

Further, the second wire 232 is a wire connecting the source side of the P-type input transistor Tp0 disposed in the second current generation unit 214 and the source sides of the P-type output transistors Tp1, Tp2, . . . , Tpn disposed in the current mirroring units 220*a*, 220*b*, . . . , 220*n* to each other, and the current mirroring units 220*a*, 220*b*, . . . , 220*n* each have a predetermined element area, so the source sides of the P-type output transistors Tp1, Tp2, . . . , Tpn may be connected to different positions on the second wire 232. Further, there are line resistances Rp1, Rp2, . . . , Rpn in the second wire 232 and the P-type mirroring current Ip1, Ip2, . . . , Ipn flow through the second wire 232, so the source side voltages Vsp+Δp1, Vsp+Δp2, . . . , Vsp+Δpn of the P-type output transistors Tp1, Tp2, . . . , Tpn may be different.

Due to the line resistances in the first wire 230 and the second wire 232, the source side voltages of the output transistors are different and the mirroring currents flowing to the output transistors are also different. However, in the current mirroring circuit 200 according to an embodiment, the deviations of mirroring currents caused by line resistances are offset by the P-type output transistors Tp1, Tp2, . . . , Tpn and the N-type output transistors Tn1, Tn2, . . . , Tnn that are disposed at upper and lower portions, respectively, so the differences can be considerably reduced.

An example of offsetting a deviation is described with reference to the first current mirroring unit 220*a*.

$$It1=Ip1-In1 \quad \text{[Equation 1]}$$

The first test current It1 flowing to the first output terminal OUT1 can be determined, as in Equation 1, as the difference between the first P-type mirroring current Ip1 and the first N-type mirroring current In1.

$$Ip1=kp*(Vsp-\Delta p1-Vgp-Vth)\hat{}2 \quad \text{[Equation 2]}$$

$$In1=kp*(Vgn-Vsn-\Delta n1-Vth)\hat{}2 \quad \text{[Equation 3]}$$

The first P-type mirroring current Ip1 can be determined, as in Equation 2, by squaring a value obtained by subtracting a threshold voltage Vth from a gate-source voltage Vsp−Δp1−Vgp and then multiplying the resultant value by a transistor coefficient kp. The first N-type mirroring current In1 can be determined, as in Equation 3, by squaring a value obtained by subtracting the threshold voltage Vth from a gate-source voltage Vgn−Vsn−Δn1 and then multiplying the resultant value by the transistor coefficient kp.

$$It1=kp*(Vsp-Vgp-Vgn+Vsn-(\Delta p1-\Delta n1))*(Vsp-Vgp+Vgn-Vsn-\Delta p1-\Delta n1-2*Vth) \quad \text{[Equation 4]}$$

Arranging Equations 1, 2, and 3, the first test current It1 can be expressed as in Equation 4.

$$Vsp-Vgp+Vgn-Vsn>>\Delta p1+\Delta n1+2*Vth \quad \text{[Equation 5]}$$

In Equation 5, the sum of the gate-source voltages Vsp−Vgp+Vgn−Vsn is much larger than the sum of voltage drops Δp1 and Δn1 and two times of the threshold voltage Vth, so the sum of voltage drops Δp1 and Δn1 and two times of the threshold voltage Vth can be ignored in Equation 4.

$$It1\approx kp*(Vsp-Vgp-Vgn+Vsn-(\Delta p1-\Delta n1))*(Vsp-Vgp+Vgn-Vsn) \quad \text{[Equation 6]}$$

Arranging Equation 4 on the basis of Equation 5, the first test current It1 can be expressed as in Equation 6.

$$Ip0-In0=kp*(Vsp-Vgp-Vgn+Vsn)*(Vsp-Vgp+Vgn-Vsn) \quad \text{[Equation 7]}$$

Equation 7 shows a value obtained by subtracting the first current In0 from the second current Ip0 and Δp1−Δn1 is the difference between Equations 6 and 7. In the current mirroring circuit 200 according to an embodiment, the upper portion and the lower portion have a symmetric relationship, so Δp1−Δn1 is small and the difference between the value obtained by subtracting the first current In0 from the second current Ip0 and the first test current It1 is also not large.

Further, the voltage drop Δp1 occurring in the second wire 232 and the voltage drop Δn1 in the first wire 230 may be adjusted to be the same, depending on the design of a second wire-first line resistance Rp1 and a first wire-first line resistance Rn1.

$$\Delta p1=Rp1*(Ip1+Ip2+\ldots+Ipn) \quad \text{[Equation 8]}$$

The voltage drop Δp1 in the second wire 232 can be calculated, as in Equation 8, by multiplying the second wire-first line resistance Rp1 between the source side of the P-type input transistor Tp0 and the source side of the first P-type output transistor Tp1 by the sum of the P-type mirroring currents Ip1, Ip2, . . . , Ipn.

$$\Delta n1=Rn1*(In1+In2+\ldots+Inn) \quad \text{[Equation 9]}$$

Further, the voltage drop Δn1 in the first wire 230 can be calculated, as in Equation 9, by multiplying the first wire-first line resistance Rn1 between the source side of the N-type input transistor Tn0 and the source side of the first N-type output transistor Tn1 by the sum of the N-type mirroring currents In1, In2, . . . , Inn.

In Equations 8 and 9, it is possible to make Δp1−Δn1 substantially 0 or a very small value by appropriately designing the second wire-first line resistance Rp1 and the first wire-first line resistance Rn1. For example, the product of the second wire-first line resistance Rp1 and the second current Ip0 and the product of the first wire-first line resistance Rn1 and the first current In0 have values within a predetermined error range, Δp1−Δn1 can be substantially 0 or very small, which can be ignored.

The description referring to Equations 1 to 9 can be applied to all of the current mirroring units 220*a*, 220*b*, . . . , 220*n*, and accordingly, the current mirroring unit 200 can supply test currents It1, It2, . . . , Itn having small deviations to all of the output terminals OUT1, OUT2, . . . , OUTn.

The source sides of the N-type output transistors Tn1, Tn2, . . . , Tnn of the current mirroring units 220*a*, 220*b*, . . . , 220*n* may be connected to different positions with regular intervals on the first wire 230. In this embodiment, when the width and thickness of the first wire 230 are uniform, the magnitudes of the line resistances Rn1, Rn2, . . . , Rnn disposed between adjacent N-type output transistors Tn1, Tn2, . . . , Tnn can be substantially the same.

Further, the source sides of the P-type output transistors Tp1, Tp2, . . . , Tpn of the current mirroring units 220*a*, 220*b*, . . . , 220*n* may be connected to different positions with regular intervals on the second wire 232. In this embodiment, when the width and thickness of the second wire 232 are uniform, the magnitudes of the line resistances Rp1, Rp2, . . . , Rpn disposed between adjacent P-type output transistors Tp1, Tp2, . . . , Tpn can be substantially the same.

Assuming that a line resistance having the same magnitude in the first wire 230 and formed between the source sides of adjacent N-type output transistors Tn1, Tn2, . . . , Tnn is Rn and a line resistance disposed in the second wire 232 and formed between the source sides of adjacent P-type output transistors Tp1, Tp2, . . . , is Rp, when the product of the first current In0 and Rn and the product of the second current Ip0 and Rp have values within a predetermined error range, the voltage drop Δn occurring between the source sides of adjacent N-type output transistors Tn1, Tn2, . . . , Tnn and the voltage drop Δp occurring between the source sides of adjacent P-type output transistors Tp1, Tp2, . . . , Tpn may be substantially the same or within a predetermined error range.

The transistor coefficients kpn of the N-type output transistors Tn1, Tn2, . . . , Tnn may be the same. Further, the transistor coefficients kpp of the P-type output transistors Tp1, Tp2, . . . , Tpn may also be the same.

$$kpn = \tfrac{1}{2} * \mu n * Cox * W/L$$

$$kpp = \tfrac{1}{2} * \mu p * Cox * W/L \qquad \text{[Equation 10]}$$

where μn and μp are mobility, Cox is a process parameter, W is channel width, and L is channel thickness.

In order to make the transistor coefficients kpn of the N-type output transistors Tn1, Tn2, . . . , Tnn the same, the channel thicknesses L and widths W of the N-type output transistors Tn1, Tn2, . . . , Tnn may be substantially the same, respectively.

Further, in order to make the transistor coefficients kpp of the P-type output transistors Tp1, Tp2, . . . , Tpn the same, the channel thicknesses L and widths W of the P-type output transistors Tp1, Tp2, . . . , Tpn may be substantially the same, respectively.

Figure 3:
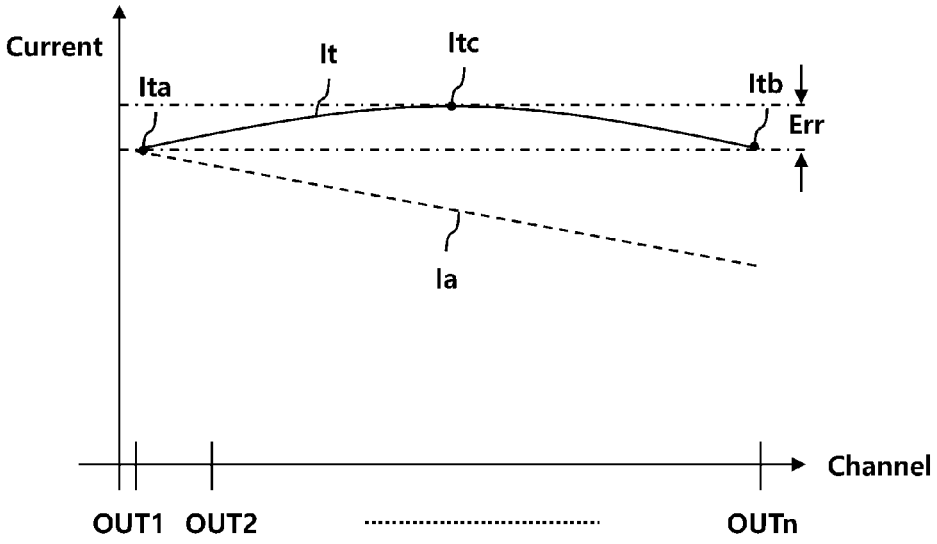
FIG. 3 is a graph showing the magnitudes of test currents depending on the positions of output terminals.

The magnitudes of the test currents It1, It2, . . . , Itn depending on the positions of the output terminals OUT1, OUT2, . . . , OUTn are shown in FIG. 3.

FIG. 3 is a graph showing the magnitudes of test currents depending on the positions of output terminals.

In FIG. 3, the dotted lines indicate the magnitudes of a test current Ia for each output terminals of the current mirroring circuit exemplified in FIG. 1 and the solid line indicates the magnitude of a test current It for each output terminal of the current mirroring circuit. In FIG. 3, when positions go toward the n-th output terminal OUTn from the first output terminal OUT1, it means they go away from current generation units.

Referring to FIG. 3, as the test currents for output terminals of the current mirroring circuit exemplified in FIG. 1 go away from current generation units, they decrease. This is because the gate-source voltages of output transistors gradually reduce as they go away from current generation units, depending on the line resistances in the source side wire of the output transistors.

On the other hand, the test currents for the output terminals of the current mirroring circuit according to an embodiment are within a predetermined error range Err regardless of the positions of the output terminals. However, the magnitudes of the test currents It at the positions of the output terminals of the current mirroring circuit according to an embodiment construct a parabola in which the magnitude of the test current Itc flowing to the output terminal at the middle position is larger or smaller than the magnitudes of the test currents Ita and Itb flowing to the output terminals at both ends. This is because the parts ignored due to the small magnitudes in Equations 1 to 8 have a fine influence. However, since this fine influence is not large, the entire test current It is in the predetermined error range Err.

The current mirroring circuit according to an embodiment can be applied to various applications. An example of employing an application through which a current mirroring circuit measures characteristics of OLED pixels is described hereafter.

Figure 4:
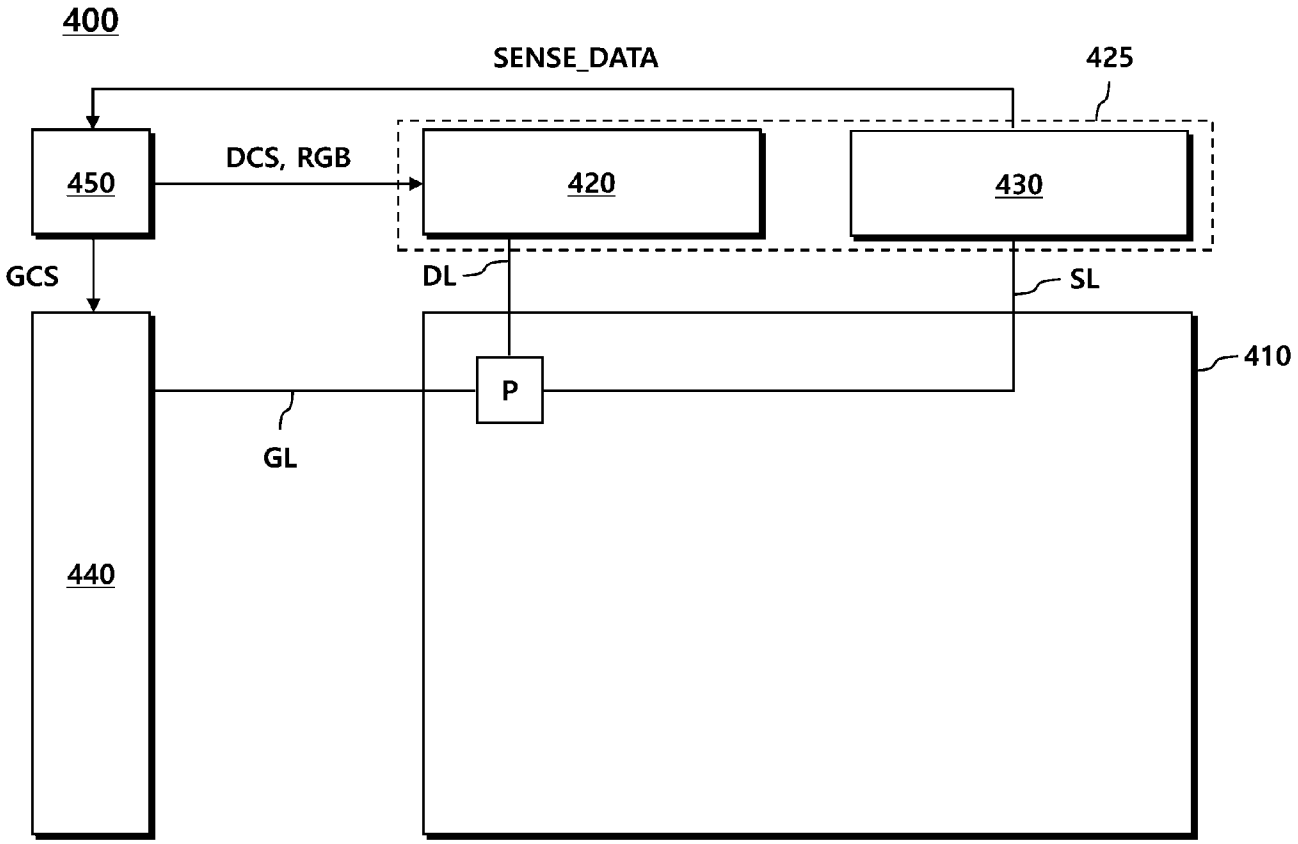
FIG. 4 is a diagram showing the configuration of an OLED display according to an embodiment.

FIG. 4 is a diagram showing the configuration of an OLED display according to an embodiment.

Referring to FIG. 4, a display 400 may include an OLED panel 410 and a panel driving apparatus 420, 430, 440, and 450 that drive the OLED panel 410.

A plurality of data lines DL, a plurality of gate lines GL, and a plurality of sensing lines SL are disposed and a plurality of pixels P may be disposed on the OLED panel 410.

The panel driving apparatus may include a data driving circuit 420, a sensing circuit 430, a gate driving circuit 440, a data processing circuit 450 etc.

In the panel driving apparatus, the gate driving circuit 440 can supply a scan signal of a turn-on voltage of a turn-off voltage to the gate lines GL. When the scan signal of a turn-on voltage is supplied to a pixel P, the pixel P is connected to s data line DL, and when the scan signal of a turn-off voltage is supplied to the pixel P, the pixel P and the data line DL are disconnected.

In the panel driving apparatus, the data driving circuit 420 supplies a data voltage to the data lines DL. The data voltage supplied to the data lines DL are transmitted to the pixels P connected to the data lines DL in response to a scan signal.

In the panel driving apparatus, the sensing circuit 430 receives signals, for example, a voltage and a current, generated in the pixels P. The sensing circuit 430 may be connected to the pixels P in response to a scan signal or may be connected to the pixels Pin response to separate sensing gate signals. The sensing gate signals can be generated by the gate driving circuit 440.

In the panel driving apparatus, the data processing circuit 450 can supply various control signals to the gate driving circuit 440 and the data driving circuit 420. The data processing circuit 450 can generate and transmit a gate control signal GCS, which starts scanning at a timing implemented at each frame, to the gate driving circuit 440. Further, the data processing circuit 450 can output image data RGB converted from image data input from the outside to fit to the data signal form that is used in the data driving circuit 420, to the data driving circuit 420. Further, the data processing circuit 450 can transmit a data control signal DCS for controlling the data driving circuit 420 to supply a data voltage to the pixels P at the timings.

The data processing circuit 450 can compensate for and transmit the image data RGB in accordance with the characteristics of the pixels P. The data processing circuit 450 can receive pixel sensing data SENSE_DATA from the sensing circuit 430. Measured values for the characteristics of the pixels P may be included in the pixel sensing data SENSE_DATA.

Meanwhile, the data driving circuit 420 may be called a source driver. Further, the gate driving circuit 440 may be called a gate driver. Further, the data processing circuit 450 may be called a timing controller. The data driving circuit 420 and the sensing circuit 430 may be included in one integrated circuit 125 and may be called, in combination, an OLED driver. Further, the data driving circuit 420, sensing circuit 430, and data processing circuit 450 may be included in one integrated circuit and may be called, in combination, an integrated IC. This embodiment is not limited to these names, but some components generally known in a source driver, a gate driver, and a timing controller are not described in the following description. Accordingly, it should be considered that some components are not provided when understanding embodiments.

Meanwhile, the pixels P disposed on the OLED panel 410 may each include an OLED (Organic Light Emitting Diode) and one or more transistors. The characteristics of the OLED and the transistors included in each of the pixels P may change, depending on time or the surrounding environment. The sensing circuit 430 according to an embodiment can sense and transmit the characteristics of the components included in each of the pixels P to the data processing circuit 450.

The current mirroring circuit described with reference to FIGS. 2 and 3 may be included in the sensing circuit 430. The function of a current mirroring circuit in the sensing circuit 430 is described with reference to FIG. 5.

Figure 5:
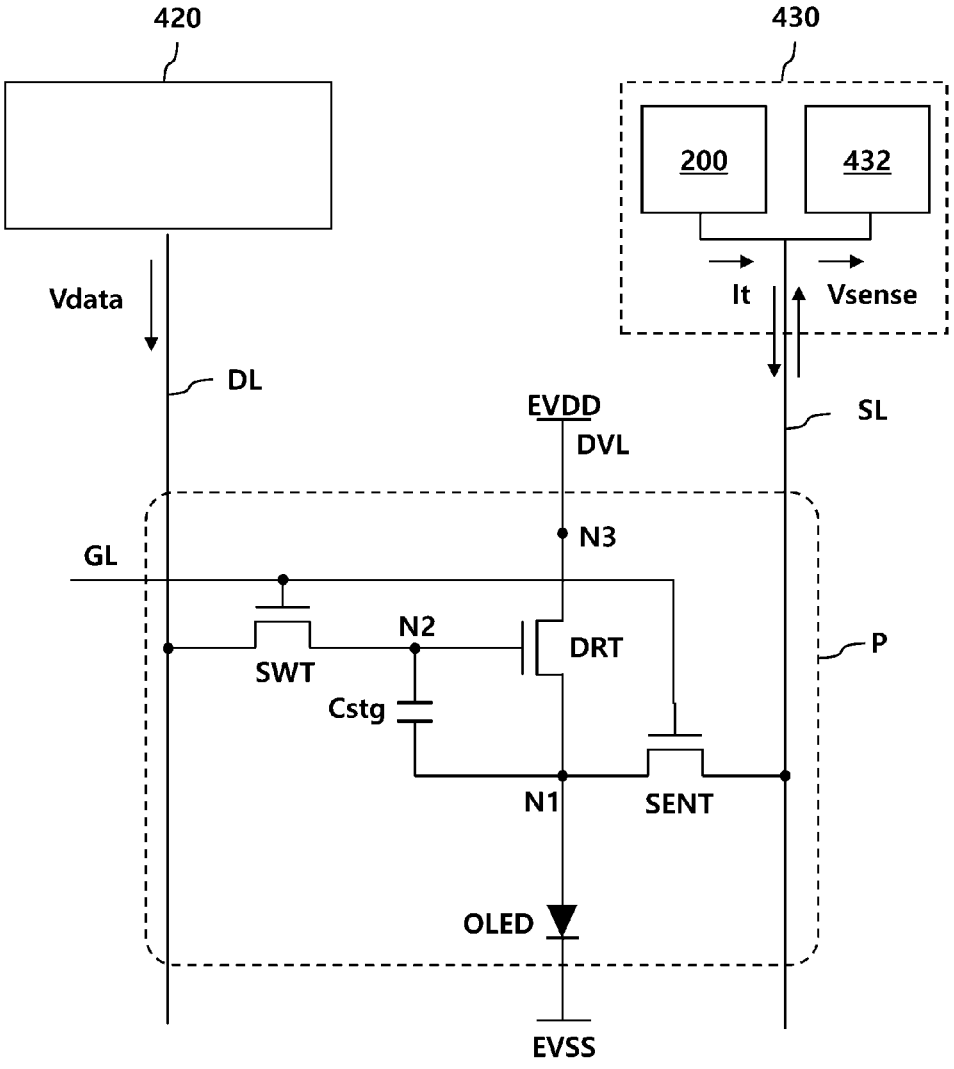
FIG. 5 is a diagram showing the pixel structure of each of the pixels of FIG. 4 and signals input/output to a pixel from a data driving circuit and a sensing circuit.

FIG. 5 is a diagram showing the pixel structure of each of the pixels of FIG. 4 and signals input/output to a pixel from a data driving circuit and a sensing circuit.

Referring to FIG. 5, a pixel P may include an organic light emitting diode OLED, a driving transistor DRT, a switching transistor SWT, a sensing transistor SENT, a storage capacitor Cstg, etc.

The organic light emitting diode OLED may include an anode, an organic layer, a cathode etc. The anode is controlled to be connected to a driving voltage EVDD and the cathode is controlled to be connected to a base voltage EVSS by the driving transistor DRT, thereby emitting light.

The driving transistor DRT can control the brightness of the organic light emitting diode OLED by controlling a driving current that is supplied to the organic light emitting diode OLED.

A first node N1 of the driving transistor DRT may be electrically connected to the anode of the organic light emitting diode OLED, and it may be a source node or a drain node. A second node N2 of the driving transistor DRT may be electrically connected to a source node or a drain node of the switching transistor SWT, and it may be a gate node. A third node N3 of the driving transistor DRT may be electrically connected to a driving voltage line DVL for supplying a driving voltage EVDD, and it may be a drain node or a source node.

The switching transistor SWT is electrically connected between the data line DL and the second node N2 of the driving transistor DRT and can be turned on by receiving a scan signal through the gate line GL.

When the switching transistor SWT is turned on, a data voltage Vdata supplied from the data driving circuit 420 through the data line DL is transmitted to the second node N2 of the driving transistor DRT.

The storage capacitor Cstg may be electrically connected between the first node N1 and the second node N2 of the driving transistor DRT.

The storage capacitor Cstg may a parasitic capacitor between the first node N1 and the second node N2 of the driving transistor DRT and may be an external capacitor intentionally designed outside the driving transistor DRT.

The sensing transistor SENT may connect the first node N1 of the driving transistor DRT and the sensing line S to each other.

When the first node N1 and the sensing line S are connected to each other, the current mirroring circuit 200 included in the sensing circuit 430 can supply a test current It to the organic light emitting diode OLED. The sensing signal processing circuit 432 included in the sensing circuit 330 can receive and process a signal Vsense, for example, a voltage generated in the organic light emitting diode OLED. The sensing circuit 430 measures the characteristics of the pixel P using the signal Vsense transmitted through the sensing line SL.

By measuring the signal Vsense generated in the organic light emitting diode OLED, it is possible to know the degree of deterioration of the organic light emitting diode OLED such as parasitic capacitance and a current characteristic of the organic light emitting diode OLED.

The sensing circuit 430 can transmit the measured value to the data processing circuit 450 (see FIG. 4). The data processing circuit 450 (see FIG. 4) can find out the characteristics of pixels P by analyzing the measured value.

Meanwhile, the sensing circuit 430 is supposed to measure characteristic values of a plurality of pixels P disposed on the OLED panel, in which in order to reduce the measuring time, the current mirroring circuit 200 can supply the test current It simultaneously to a plurality of sensing lines SL through a plurality of output terminals. The sensing signal processing circuit 432 can produce pixel sensing data SENSE_DATA (see FIG. 4) by digitalizing the signal Vsense generated in the pixels P by the test current It.

The test current It output from the output terminals may have a deviation within a predetermined error range, as described with reference to FIGS. 2 to 3. For example, as shown in FIG. 3, the magnitudes of the test current It at the positions of the output terminals of the current mirroring circuit 200 may construct a parabola in which the magnitude of the test current flowing to the output terminal at the middle position is larger or smaller than the magnitudes of the test currents flowing to the output terminals at both ends.

Meanwhile, the sensing circuit 430 and the data driving circuit 420 can organically operate so that the characteristics of the pixels P can be accurately sensed. For example, when the current mirroring circuit 200 supplies the test current It simultaneously to a plurality of output terminals, the data driving circuit 420 can supply a data voltage Vdata that turns off the driving transistors DRT disposed in the pixels P to the data lines DL. In this example, as the driving transistor DRT is turned off, the test current It can flow only to the organic light emitting diode OLED without being influenced from other configurations.

Meanwhile, the current mirroring circuit described with reference to FIGS. 2 and 3 can also be applied to correct a sensing error of the sensing signal processing circuit 432.

Figure 6:
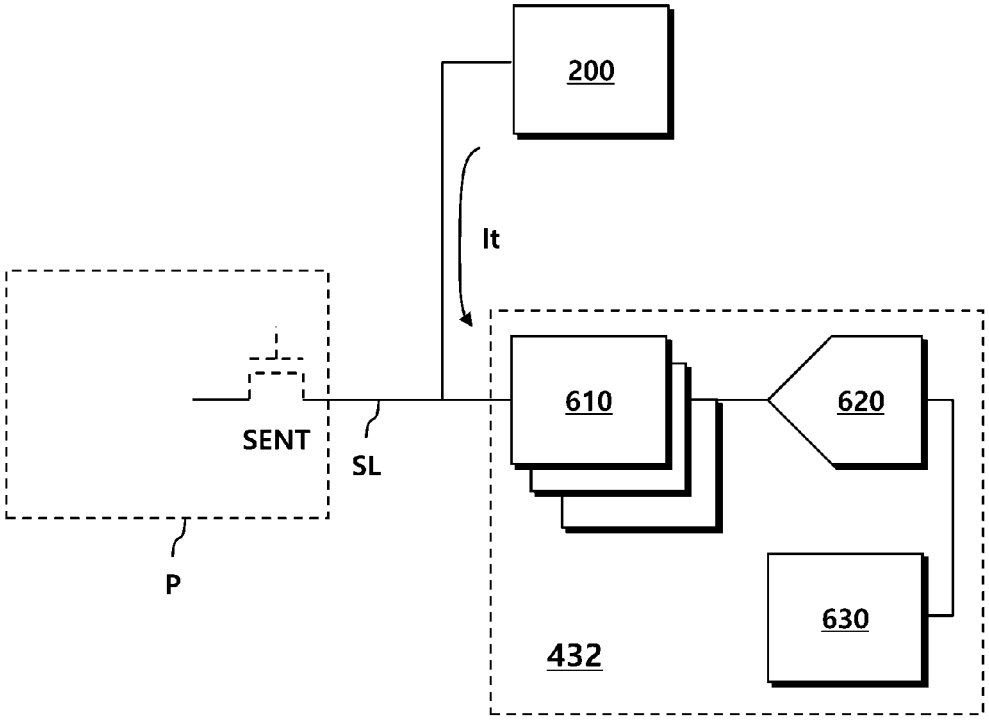
FIG. 6 is a diagram showing a process of compensating for a sensing error of a sensing signal processing circuit, using the current mirroring circuit according to an embodiment.

FIG. 6 is a diagram showing a process of compensating for a sensing error of a sensing signal processing circuit, using the current mirroring circuit according to an embodiment.

Referring to FIG. 6, the sensing signal processing circuit 432 may include a sensing unit 610 that outputs analog signals by receiving and processing sensing signals from pixels P, an analog-digital converting unit 620 that converts an analog signal into digital data, and an output unit 630 that produces and outputs pixel sensing data on the basis of the digital data.

Since the current mirroring circuit 200 supplies the test current It simultaneously to a plurality of sensing lines SL, the sensing signal processing circuit 432 may include a plurality of sensing units 610 to be able to receive a plurality of sensing signals. There may be deviations in the measured values for the sensing lines SL due to deviations of the elements disposed in the sensing units 610.

In order to compensate for deviations of the sensing units 610, the current mirroring circuit 200 can supply a plurality of test currents It simultaneously to the sensing units 610 of the sensing signal processing circuit 432, but not to the pixels P.

Referring to FIG. 6, when the sensing transistors disposed in the pixels P are turned off and the current mirroring circuit 200 supplies the test current It simultaneously to the sensing lines SL, the test current It is transmitted to the sensing units 610. As described above, since the deviation of the test current It is very small, the sensing signal processing circuit 432 can correct the measurement deviations of the sensing units 610 by comparing the values measured by the sensing units 610.

As described above, according to the embodiment, it is possible to simultaneously sense the characteristics of a plurality of OLED pixels. Accordingly, it is possible to reduce the manufacturing time and manufacturing costs. Further, according to the embodiment, the current mirroring circuit can output test currents having uniform magnitudes within a predetermined error range to a plurality of output terminals. Accordingly, it is possible to reduce a sensing error and the trouble of correcting again a sensing value.

In addition, since terms, such as "including," "comprising," and "having" mean that one or more corresponding components may exist unless they are specifically described to the contrary, it shall be construed that one or more other components can be included. All the terms that are technical, scientific or otherwise agree with the meanings as understood by a person skilled in the art unless defined to the contrary. Common terms as found in dictionaries should be interpreted in the context of the related technical writings not too ideally or impractically unless the present invention expressly defines them so.

Although a preferred embodiment of the present invention has been described for illustrative purposes, those skilled in the art will appreciate that various modifications, additions and substitutions are possible, without departing from the scope and spirit of the invention as disclosed in the accompanying claims. Therefore, the embodiments disclosed in the present invention are intended to illustrate the scope of the technical idea of the present invention, and the scope of the present invention is not limited by the embodiment. The scope of the present invention shall be construed on the basis of the accompanying claims in such a manner that all of the technical ideas included within the scope equivalent to the claims belong to the present invention.

What is claimed is:

1. A current mirroring circuit, comprising:

a current generation unit configured to generate a first current and a second current; and a plurality of current mirroring units each including an N-type output transistor configured to mirror the first current and a P-type output transistor configured to mirror the second current, and supplying a current corresponding to a difference between the mirroring current of the P-type output transistor and the mirroring current of the N-type output transistor to output terminals, wherein source sides of the N-type output transistors of the current mirroring units are connected to different positions on a first wire and source sides of the P-type output transistors of the current mirroring units are connected to different positions on a second wire, wherein magnitudes of currents at the output terminals of the current mirroring units construct a shape in which a magnitude of the current flowing to the output terminal at a middle position is larger or smaller than magnitudes of the current flowing to the output terminals at both ends.

2. The current mirroring circuit of claim 1, wherein the source sides of the N-type output transistors of the current mirroring units are connected to different positions with regular intervals on the first wire, and the source sides of the P-type output transistors of the current mirroring units are connected to different positions with regular intervals on the second wire.

3. The current mirroring circuit of claim 1, wherein channel thicknesses and widths of the N-type output transistors of the current mirroring units are substantially the same, respectively, and channel thicknesses and widths of the P-type output transistors of the current mirroring units are substantially the same, respectively.

4. The current mirroring circuit of claim 1, wherein a line resistance formed between adjacent N-type output transistors in the first wire is Rn, a line resistance formed between adjacent P-type output transistors in the second wire is Rp, and the product of the first current and Rn and the product of the second current and Rp have substantially the same value.

5. A panel driving apparatus for driving a panel including a plurality of pixels, a plurality of data lines for driving the pixels, and a plurality of sensing lines for sensing characteristics of the pixels, the panel driving apparatus comprising:

a sensing circuit including a plurality of current mirroring units configured to supply test currents to the sensing lines through a plurality of output terminals, to sense signals generated in the pixels by the test currents, to produce pixel sensing data by digitalizing the signals, to include an N-type output transistor configured to mirror a first current and a P-type output transistor configured to mirror a second current, and to supply the test currents corresponding to a difference between the mirroring current of the P-type output transistor and the mirroring current of the N-type output transistor to the output terminals; and a data driving circuit configured to receive image data compensated on the basis of the pixel sensing data, to convert the image data into a data voltage, and to supply the data voltage to the data lines.

6. The panel driving apparatus of claim 5, wherein magnitudes of the test currents at the output terminals construct a parabola in which a magnitude of the test current flowing to the output terminal at a middle position is larger or smaller than magnitudes of the test currents flowing to the output terminals at both ends.

7. The panel driving apparatus of claim 5, wherein source sides of the N-type output transistors of the current mirroring units are connected to different positions with regular intervals on a first wire, and source sides of the P-type output transistors of the current mirroring units are connected to different positions with regular intervals on a second wire.

8. The panel driving apparatus of claim 5, wherein the sensing circuit includes:

a sensing unit configured to output analog signals by receiving and processing the signals from the pixels;

an analog-digital converting unit configured to convert the analog signals into digital data; and an output unit configured to produce and output the pixel sensing data on the basis of the digital data.

9. An OLED (Organic Light Emitting Diode) driver for driving an OLED panel including a plurality of OLED pixels, a plurality of data lines for driving the OLED pixels, and a plurality of sensing lines for sensing characteristics of the OLED pixels, the OLED driver comprising:

a sensing circuit configured to include a plurality of current mirroring unit, which each includes an N-type output transistor configured to mirror a first current and a P-type output transistor configured to mirror a second current and supplies test currents corresponding to a difference between the mirroring current of the P-type output transistor and the mirroring current of the N-type output transistor to the sensing lines through output terminals, and to produce pixel sensing data by digitalizing signals generated in the sensing lines; and a data driving circuit configured to receive image data compensated on the basis of the pixel sensing data, to convert the image data into a data voltage, and to supply the data voltage to the data lines.

10. The OLED driver of claim 9, wherein when the test currents are supplied to the output terminals, the data driving circuit supplies a data voltage for turning off driving transistors disposed in the OLED pixels to the data line.

11. The OLED driver of claim 9, wherein the test currents are supplied to anodes of OLEDs.

12. The OLED driver of claim 9, wherein the N-type output transistors are NMOS s (N-channel Metal Oxide Semiconductor) and gates of the N-type output transistors of the current mirroring units are connected to each other through a third wire, and the P-type output transistors are PMOSs (P-channel Metal Oxide Semiconductor) and gates of the P-type output transistors of the current mirroring units are connected to each other through a fourth wire.

13. The OLED driver of claim 9, wherein source sides of the N-type output transistors of the current mirroring units are connected to different positions with regular intervals on a first wire, source sides of the P-type output transistors of the current mirroring units are connected to different positions with regular intervals on a second wire, and width and thickness of the first wire are uniform and width and thickness of the second wire are uniform.

14. The OLED driver of claim 9, wherein the current mirroring units output the test currents simultaneously to the output terminals.

* * * * *